US006837210B2

(12) United States Patent
Tsuchiya et al.

(10) Patent No.: US 6,837,210 B2
(45) Date of Patent: Jan. 4, 2005

(54) LUBRICATION UNIT FOR ENGINES

(75) Inventors: Masahiko Tsuchiya, Saitama (JP); Yosuke Hoi, Saitama (JP); Yoshiaki Noda, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/303,029

(22) Filed: Nov. 25, 2002

(65) Prior Publication Data

US 2003/0101960 A1 Jun. 5, 2003

(30) Foreign Application Priority Data

Nov. 30, 2001 (JP) ..... 2001-365802

(51) Int. Cl.[7] ..... F01M 1/04; F01M 1/00
(52) U.S. Cl. ..... 123/196 R; 184/6.5
(58) Field of Search ..... 123/196 R, 196 CP, 123/196 W, 195 P, 196 S, 196 A; 184/6.5, 1.5

(56) References Cited

U.S. PATENT DOCUMENTS 5,097,894 A * 3/1992 Cassia ..... 165/71
5,467,746 A * 11/1995 Waelput et al. ..... 123/196 A
6,223,713 B1 * 5/2001 Moorman et al. ..... 123/196 R

FOREIGN PATENT DOCUMENTS

JP 11-93634 A 4/1999

* cited by examiner

*Primary Examiner*—Tony M. Arganbright
*Assistant Examiner*—Hyder Ali
(74) *Attorney, Agent, or Firm*—Birch, Stewart, Kolasch & Birch, LLP

(57) ABSTRACT

An oil feed pump for feeding oil in an oil tank to an engine, an oil recovery pump for feeding oil in a crankcase into the oil tank, an oil drain pipe connected to the lower portion of the crankcase and extending upward, and an opening provided on top of the oil tank are provided in a lubrication system. An opening of the oil drain pipe opens at the position upward of the oil level in the crankcase at a moment when the oil in the oil tank is returned into the crankcase. A cap is provided with a dip stick. The engine can be mounted on a small planing boat with the crankshaft oriented in the fore-and-aft direction. The oil tank is integrally formed with the front portion of the engine so as to be elongated in the vertical direction and is formed with the opening on top.

12 Claims, 17 Drawing Sheets

LUBRICATION UNIT FOR ENGINES

CROSS-REFERENCES TO RELATED APPLICATIONS

This nonprovisional application claims priority under 35 U.S.C. §119(a) on Patent Application No. 2001-365802 filed in Japan on Nov. 30, 2001, the entirety of which is herein incorporated by reference.

BACKGROUND OF THE INVENTION

1. Field of the Invention

The present invention relates to a lubrication unit for engines, and more particularly to a lubrication unit for engines suitable for mounting on a planing watercraft such as a small planning boat.

2. Description of the Background Art

As seen in FIG. 17 of the present application, an engine employing a lubrication system has been available in the background art. The engine is further described in JP-A-11-93634, the entirety of which is hereby incorporated by reference. The engine 1 is mounted on a small, planing boat 2, and includes an oil feed pump (not shown) for feeding oil in an oil tank 3 provided on the side thereof to the engine 1, a crankcase 4 in which oil used for lubricating each part of the engine is collected, and an oil recovery pump (not shown) for feeding oil from the crankcase 4 to the oil tank 3. An opening 3*a* is provided on top of the oil tank 3, and the opening 3*a* is secured by a cap 6 having a dip stick (oil level gauge) 5.

The aforementioned engine 1 is mounted on the small planing boat 2. Since there is only a slight space between an engine bottom 1*a* and a bottom of the vessel body 2*a*, one has to remove the aforementioned cap 6, insert a tube for sucking oil from the opening 3*a*, and drain the oil when changing engine oil. Therefore, the present inventors have determined that the oil in the oil tank 3 can be drained relatively satisfactorily. However, the oil in the crankcase 4 cannot be drained easily and/or satisfactorily with this arrangement of the background art.

SUMMARY OF THE INVENTION

The present invention overcomes the shortcomings associated with the background art and achieves other advantages not realized by the background art.

An object of the present invention is to provide a lubrication unit for engines in which the aforementioned problems of the background art are solved, e.g., oil residing within an engine can be changed easily and satisfactorily.

One or more of these and other objects are accomplished by an engine comprising a crankcase; an oil tank being provided independently of an interior of the crankcase and having oil therein; an oil feed pump for feeding oil in the oil tank to the engine, wherein oil used for lubricating parts of the engine is collected within the crankcase; an oil recovery pump for feeding oil in the crankcase to the oil tank; an oil drain pipe connected to a lower portion of the crankcase and extending upwardly therefrom; and an opening provided on an upper portion of the oil tank.

One or more of these and other objects are further accomplished by a small planning boat, the small planning boat comprising an engine mounted on the small planing boat with a crankshaft thereof oriented in a fore-and-aft direction of the boat, wherein the engine further includes a crankcase; an oil tank being provided independently of an interior of the crankcase and having oil therein; an oil feed pump for feeding oil in the oil tank to the engine, wherein oil used for lubricating parts of the engine is collected within the crankcase; an oil recovery pump for feeding oil in the crankcase to the oil tank; an oil drain pipe connected to a lower portion of the crankcase and extending upwardly therefrom; and an opening provided on an upper portion of the oil tank, wherein the oil tank is integrally formed with a front portion of the engine and elongated in a vertical direction.

One or more of these and other objects are further accomplished by a lubrication system for an engine having a crankcase, the lubrication system comprising an oil tank being provided independently of an interior of the crankcase and having oil therein; an oil feed pump for feeding oil in the oil tank to the engine, wherein oil used for lubricating parts of the engine is collected within the crankcase; an oil recovery pump for feeding oil in the crankcase to the oil tank; an oil drain pipe connected to a lower portion of the crankcase and extending upwardly therefrom; and an opening provided on an upper portion of the oil tank.

Since the lubrication unit for engines includes an oil drain pipe connected to the lower portion of the aforementioned crankcase and extending upward, and an opening provided on top of the aforementioned oil tank, the oil in the oil tank can be drained by inserting a tube for drawing oil from the opening on top of the oil tank when changing oil. The oil in the crankcase can be drained by inserting a tube for drawing oil from the opening of the oil drain pipe. According to this lubrication unit for engines, oil changes can be performed easily and satisfactorily, especially when the engine is mounted on the small planing boat and there is no working space between the engine bottom and the ship bottom. Oil changes can be performed easily and satisfactorily from a position above the engine.

Since the lubrication unit for engines in an oil lubrication unit for engines is constructed in such a manner that the opening of the aforementioned oil drain pipe is opening at a position above the oil level in the crankcase at the moment when the oil in the oil tank is returned into the crankcase, the following additional effects are achieved. When the engine is left standing for a long period of time, the oil in the oil tank may gradually be returned into the crankcase through the oil pump (oil recovery pump or oil feed pump). For example, assuming that the opening of the oil drain pipe opens downward of the oil level in the crankcase, there arises such problem that the oil leaks when the cap clogging the opening is removed. Since the opening of the oil drain pipe opens upward of the oil level in the crankcase at the moment when the oil in the oil tank returns into the crankcase, leakage of oil when the cap is removed from opening after the engine is left standing may be avoided.

Since the lubrication unit for engines is constructed in such a manner that the opening on top of the aforementioned oil tank permits the dip stick to be inserted and pulled out, and the opening of the aforementioned oil drain pipe is free to insert and pull out the dip stick as well, the following additional effects may be achieved. When the engine is left stand for a long time, the oil in the oil tank may gradually be returned into the crankcase through the oil pump. In such a case, the normal method of measurement, e.g., a method of measurement by the use of the dip stick provided on the cap clogging the aforementioned opening of the oil tank, suffers from the problem of the quantity of oil not being capable of being checked, including the presence or absence of oil.

In contrast, with the lubrication unit according to the present invention, the quantity of oil can be checked by inserting the dip stick through the opening of the oil drain pipe. Even when the engine is left standing for a long period of time, the presence or absence of oil and the approximate oil quantity can be checked before starting the engine.

Since the lubrication unit for the engine mounted on the small planing boat with the crankshaft thereof oriented in the fore-and-aft direction, and the oil tank is integrally formed with the front portion of the engine so as to be elongated in the vertical direction and is formed with the opening on top thereof, the oil can be easily drained by inserting the tube for drawing oil through the opening on top of the vertically elongated oil tank. Therefore, oil changes can be performed easily and satisfactorily from a position above the vessel body.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein:

FIG. 9(*b*) is a front view of the tank body of the present invention;

FIG. 9(*c*) is a cross sectional view taken along the line c—c in the FIG. 9(*b*);

FIG. 9(*d*) is a cross sectional view taken along the line d—d in the FIG. 9(*a*);

FIG. 11(*b*) is a cross sectional view taken along the line f—f in FIG. 9(*b*);

FIG. 12(*b*) is a cross sectional view taken along the line b—b in FIG. 12(*a*);

FIG. 12(*c*) is a cross sectional view taken along the line c—c in FIG. 12(*a*); and FIG. 12(*d*) is a cross sectional view taken along the line d—d in FIG. 12(*a*);

FIG. 13(*b*) is a view seen in the direction indicated by the arrow b in FIG. 13(*a*); FIG. 13(*c*) is a cross sectional view taken along the line c—c in FIG. 13(*a*);

DETAILED DESCRIPTION OF THE PREFERRED EMBODIMENTS

Figure 1:
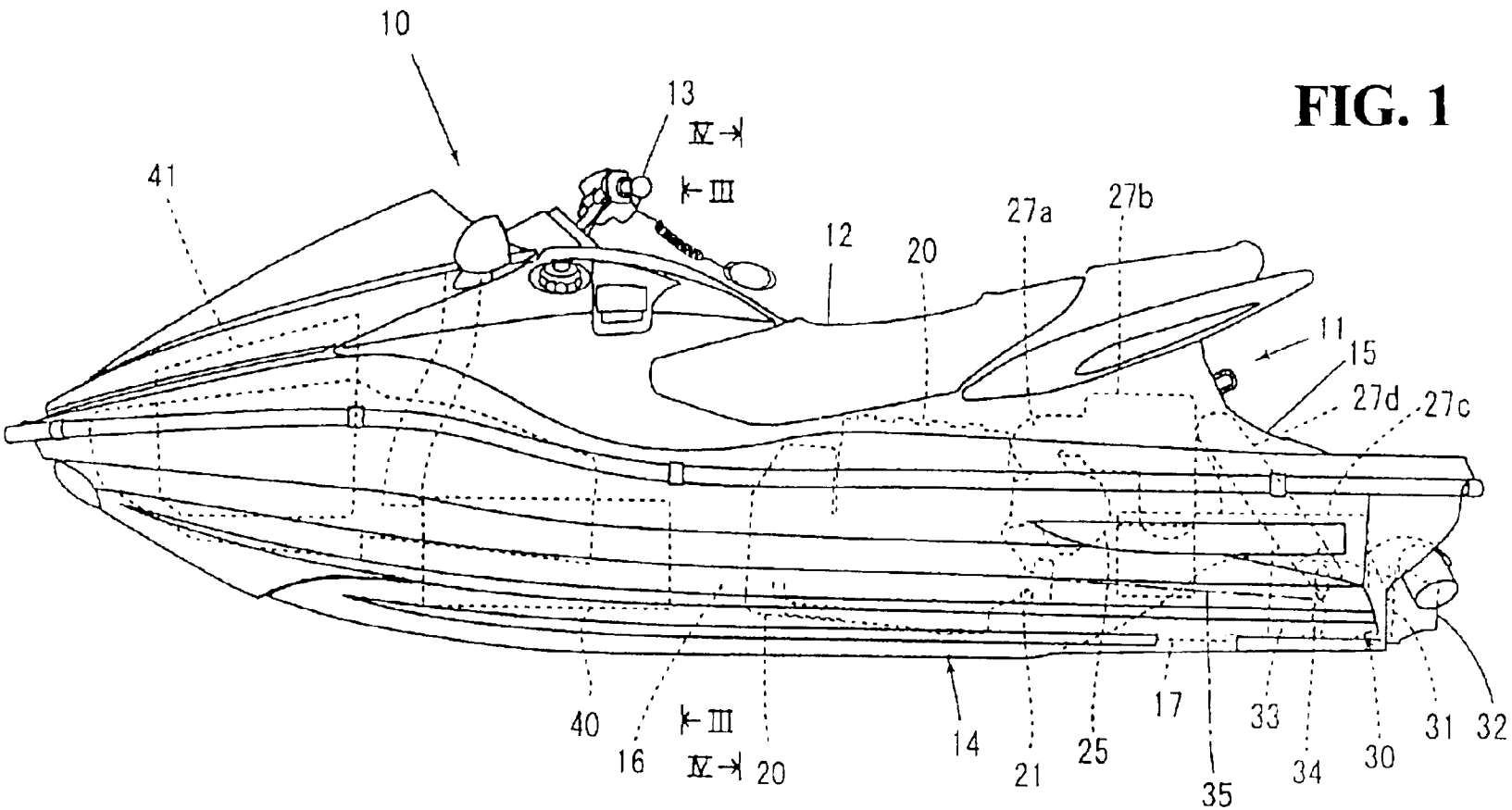
FIG. 1 is a side view of an exemplary small, planing boat having a lubrication unit for an engine according to an embodiment of the present invention.
Figure 2:
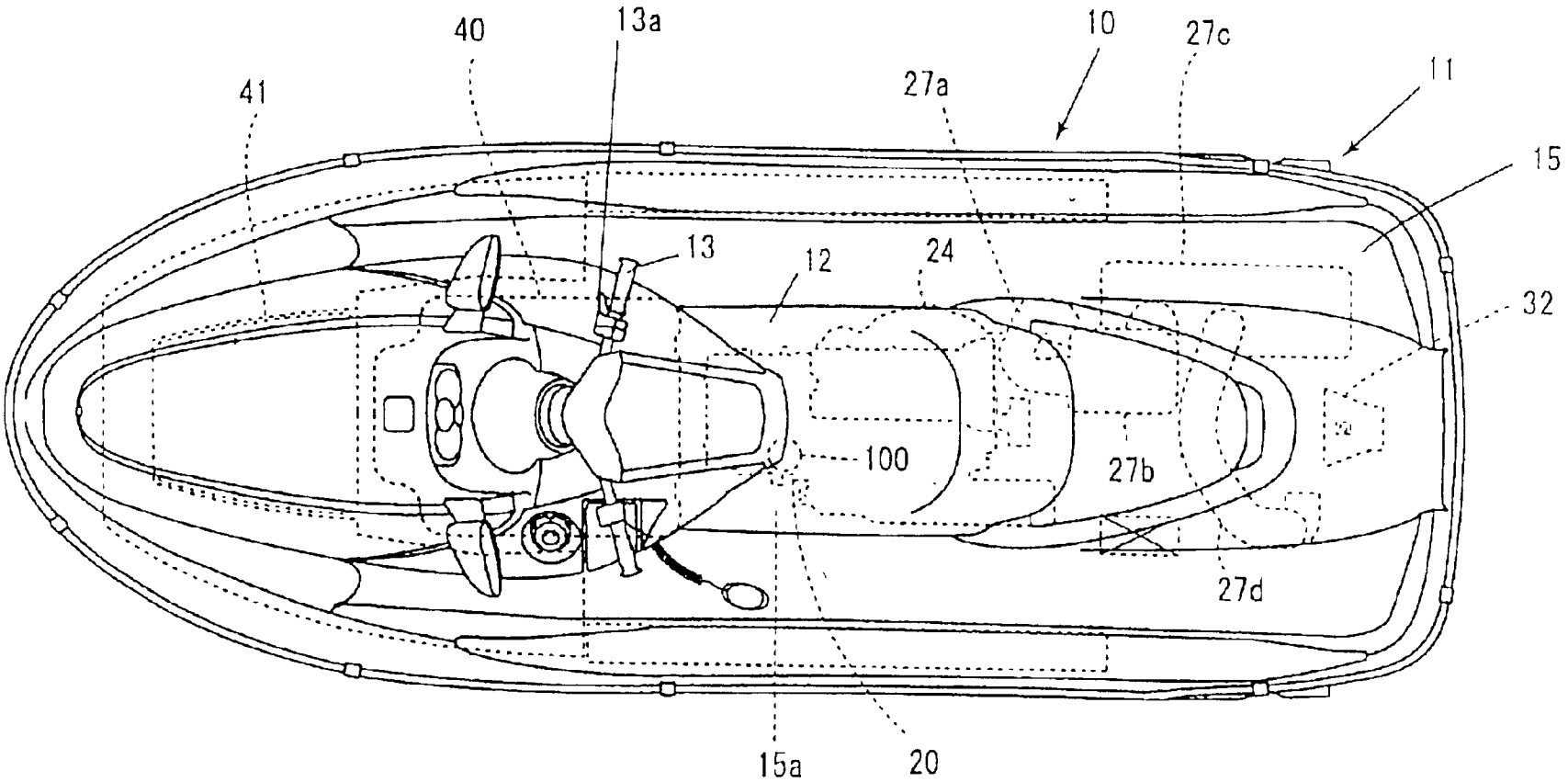
FIG. 2 is a plan view of the boat as seen in FIG. 1.
Figure 3:
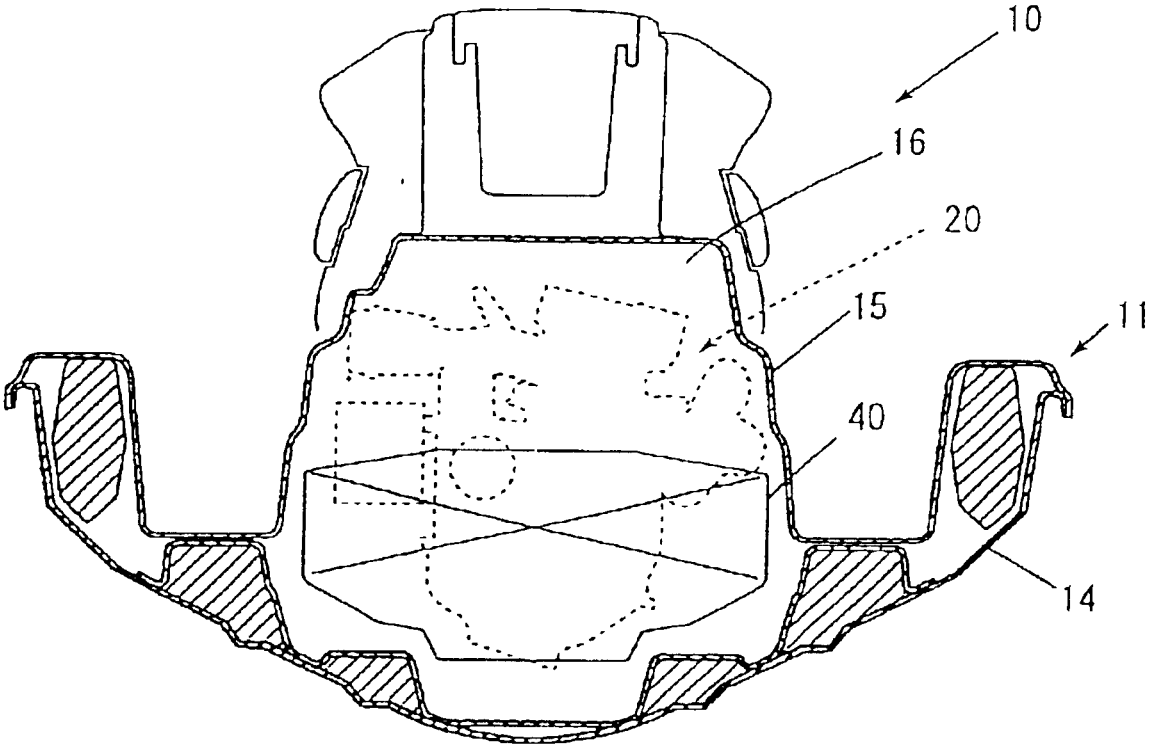
FIG. 3 is a partially enlarged, cross sectional view taken along the line III—III in FIG. 1.
Figure 4:
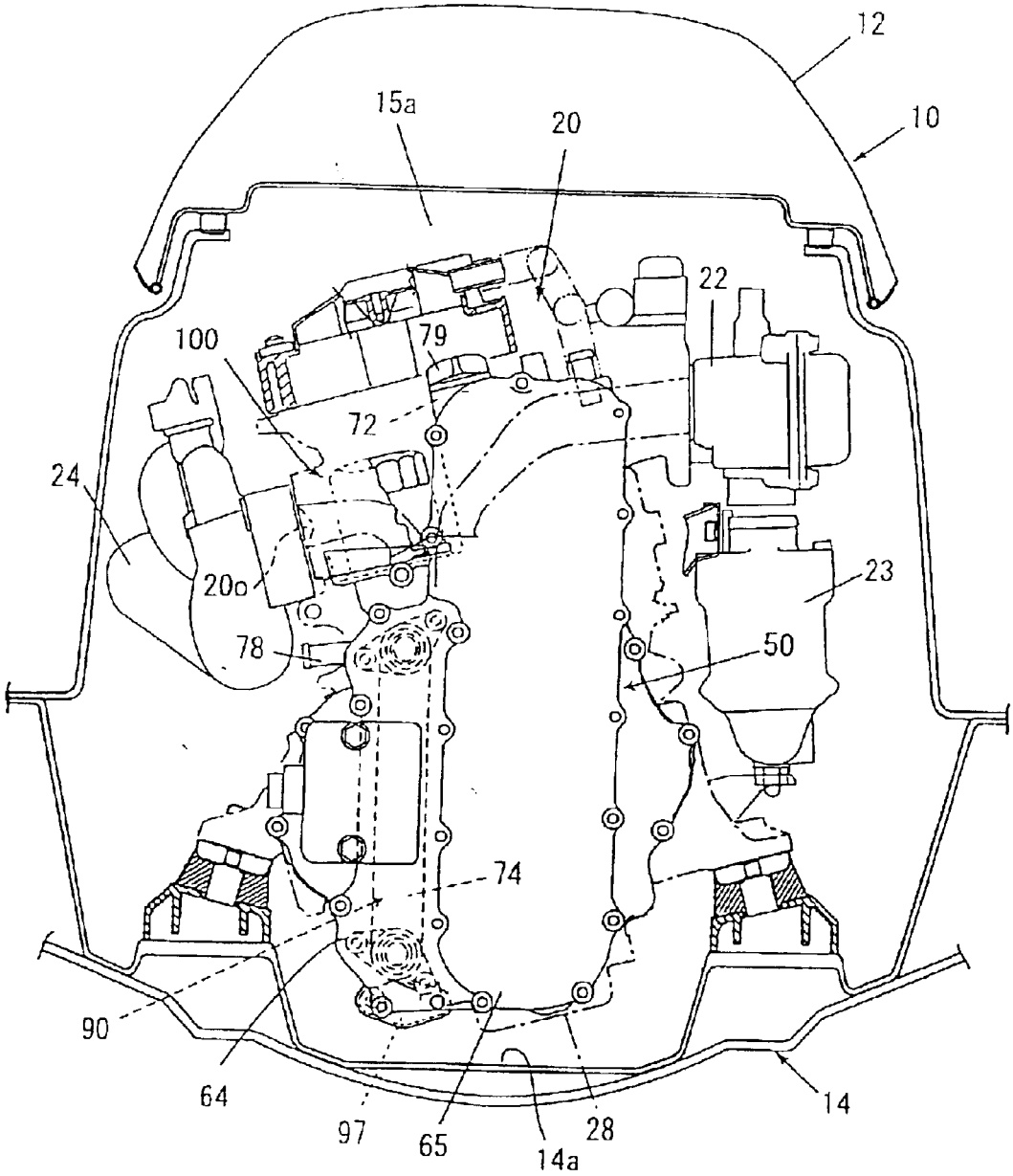
FIG. 4 is a partially enlarged, cross sectional view of the engine taken along the line IV—IV in FIG. 1.
Figure 5:
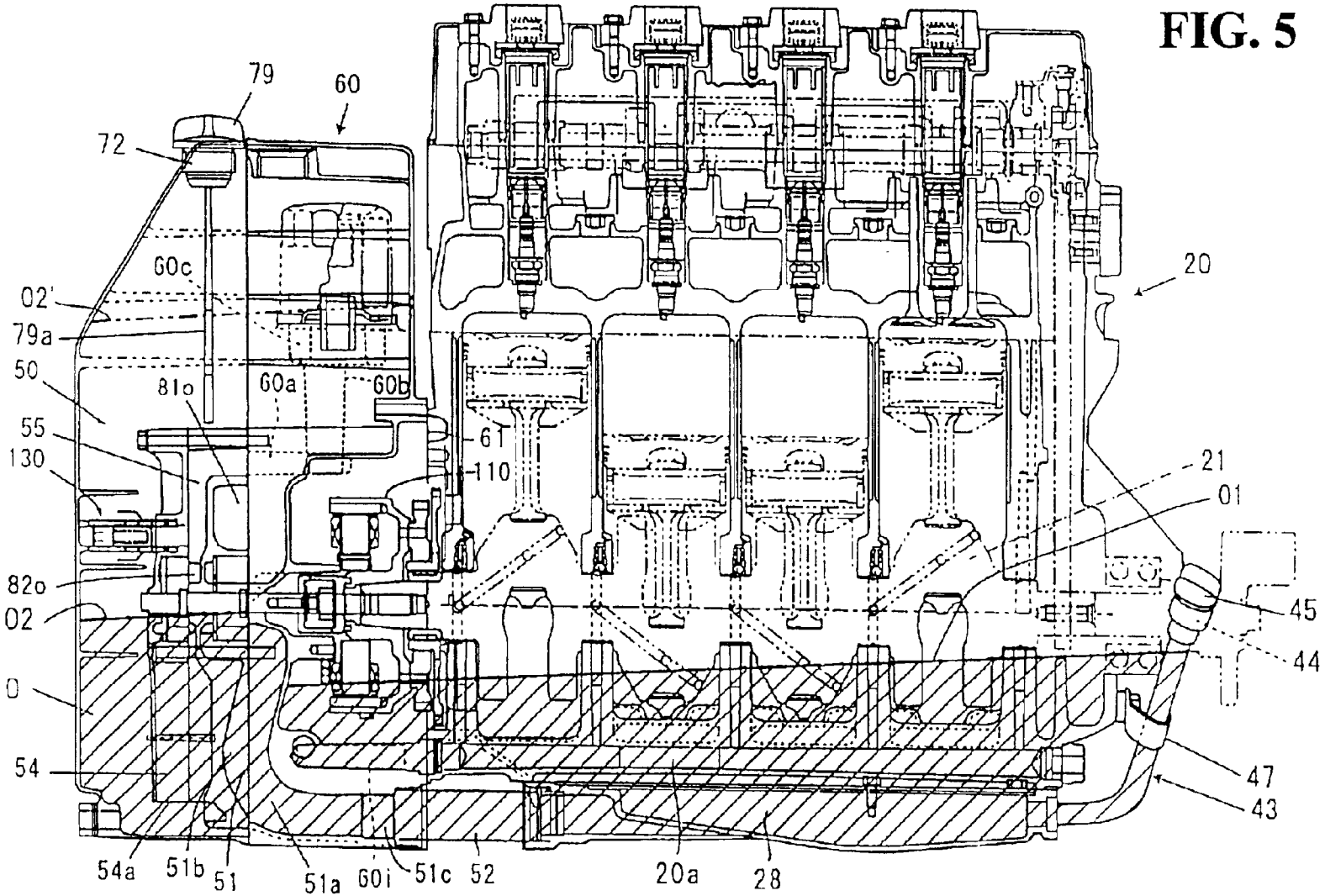
FIG. 5 is a right side view of the engine according to the present invention.
Figure 6:
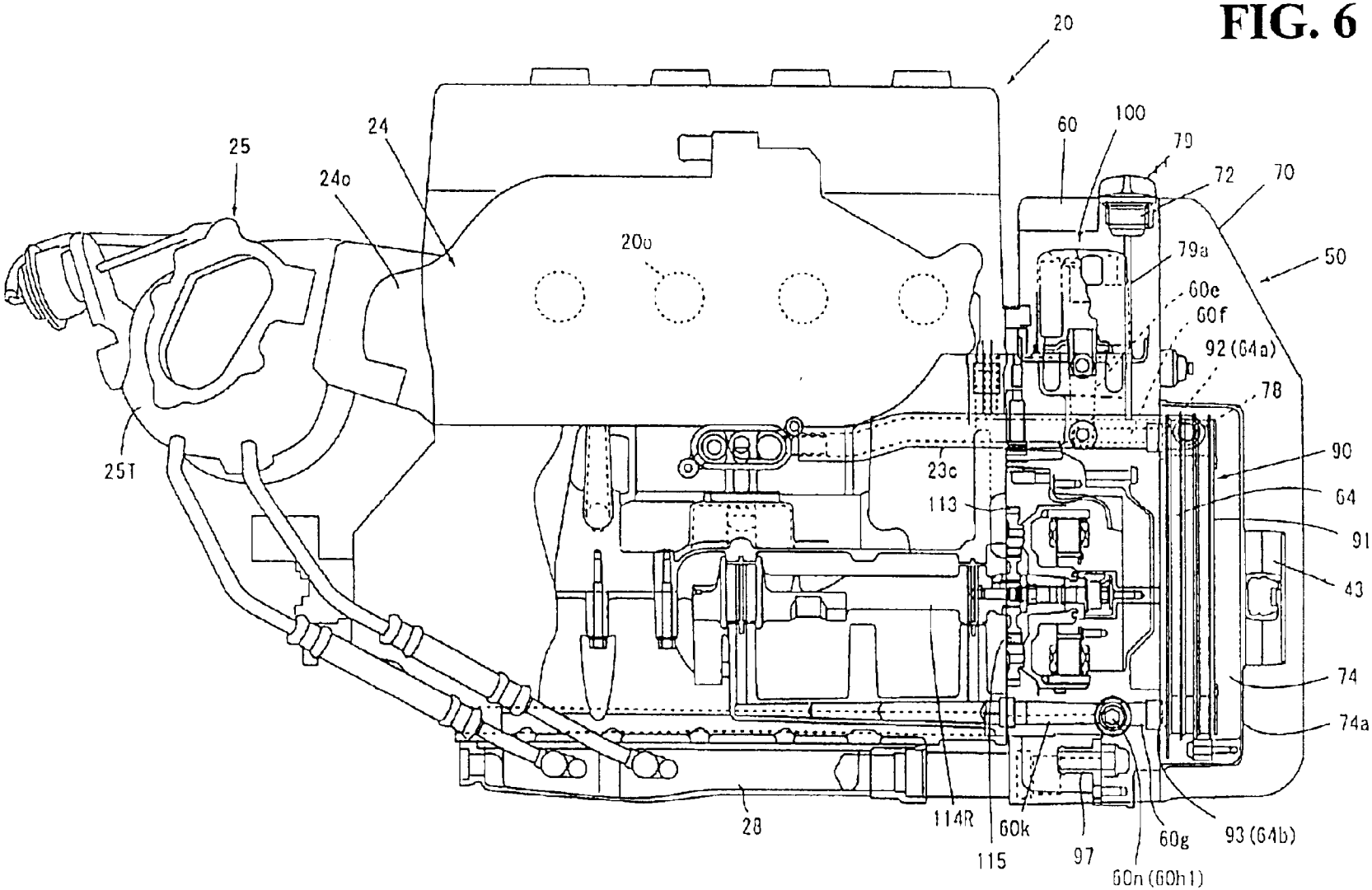
FIG. 6 is a left side view of the engine according to the present invention.
Figure 7:
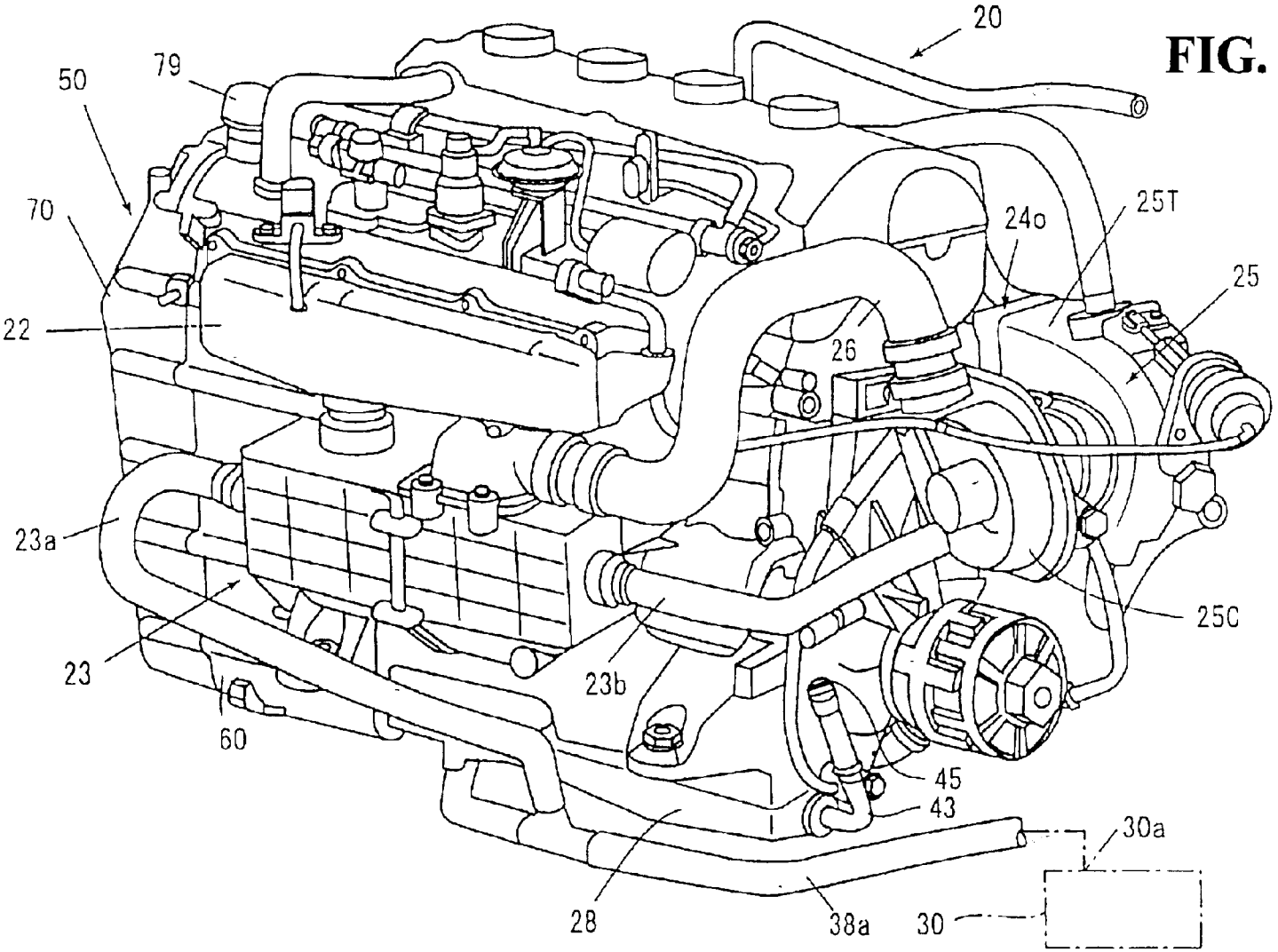
FIG. 7 is a rear perspective view of the engine as viewed obliquely from a rear position.
Figure 8:
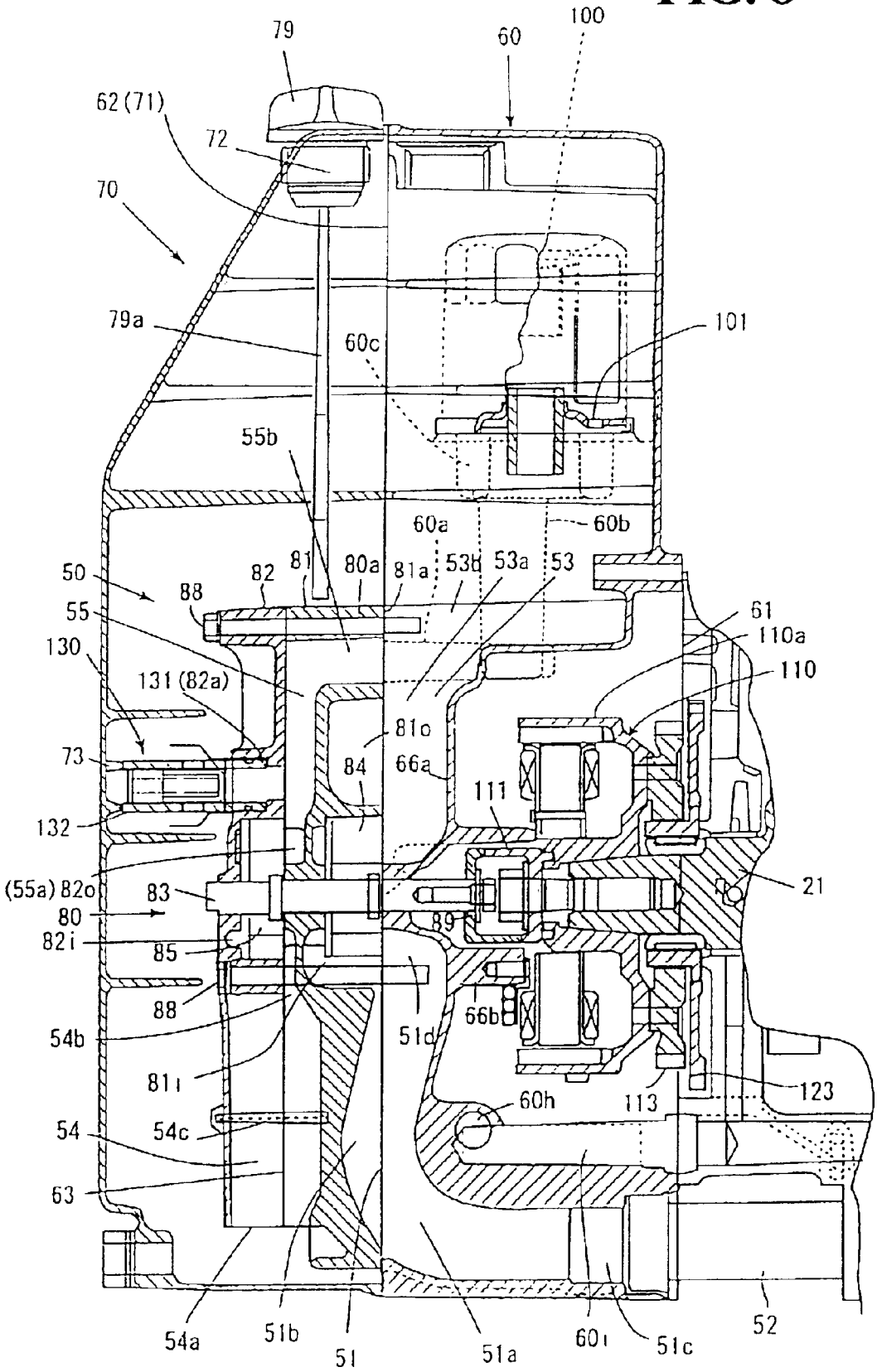
FIG. 8 is a partially enlarged view of FIG. 5.
Figure 9A:
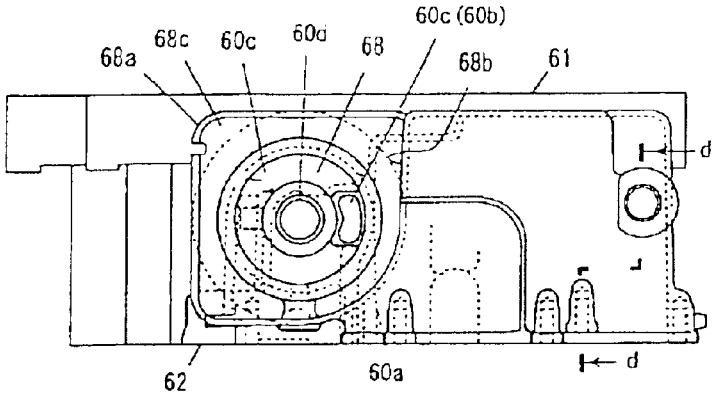
FIG. 9(*a*) is a plan view of a tank body according to an embodiment of the present invention.
Figure 9D:
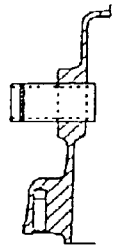
Figure 9B:
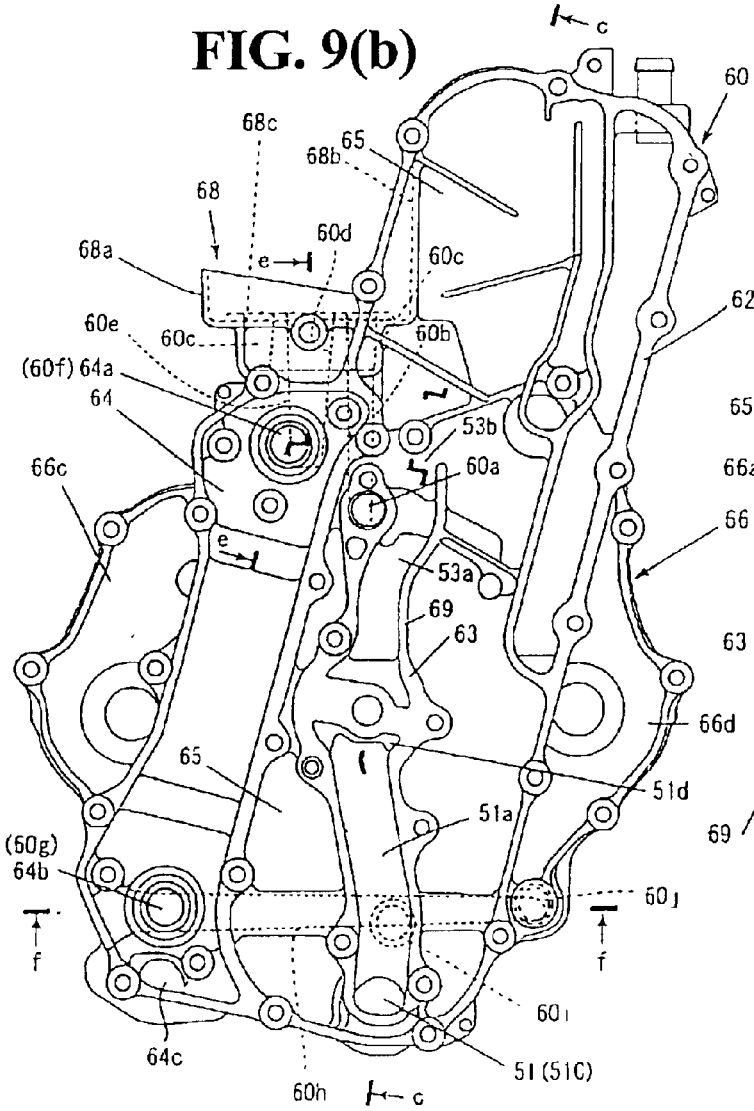
Figure 9C:
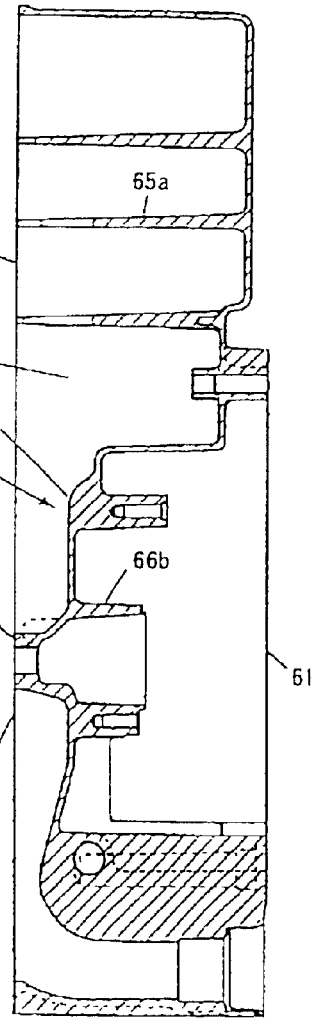
Figure 10:
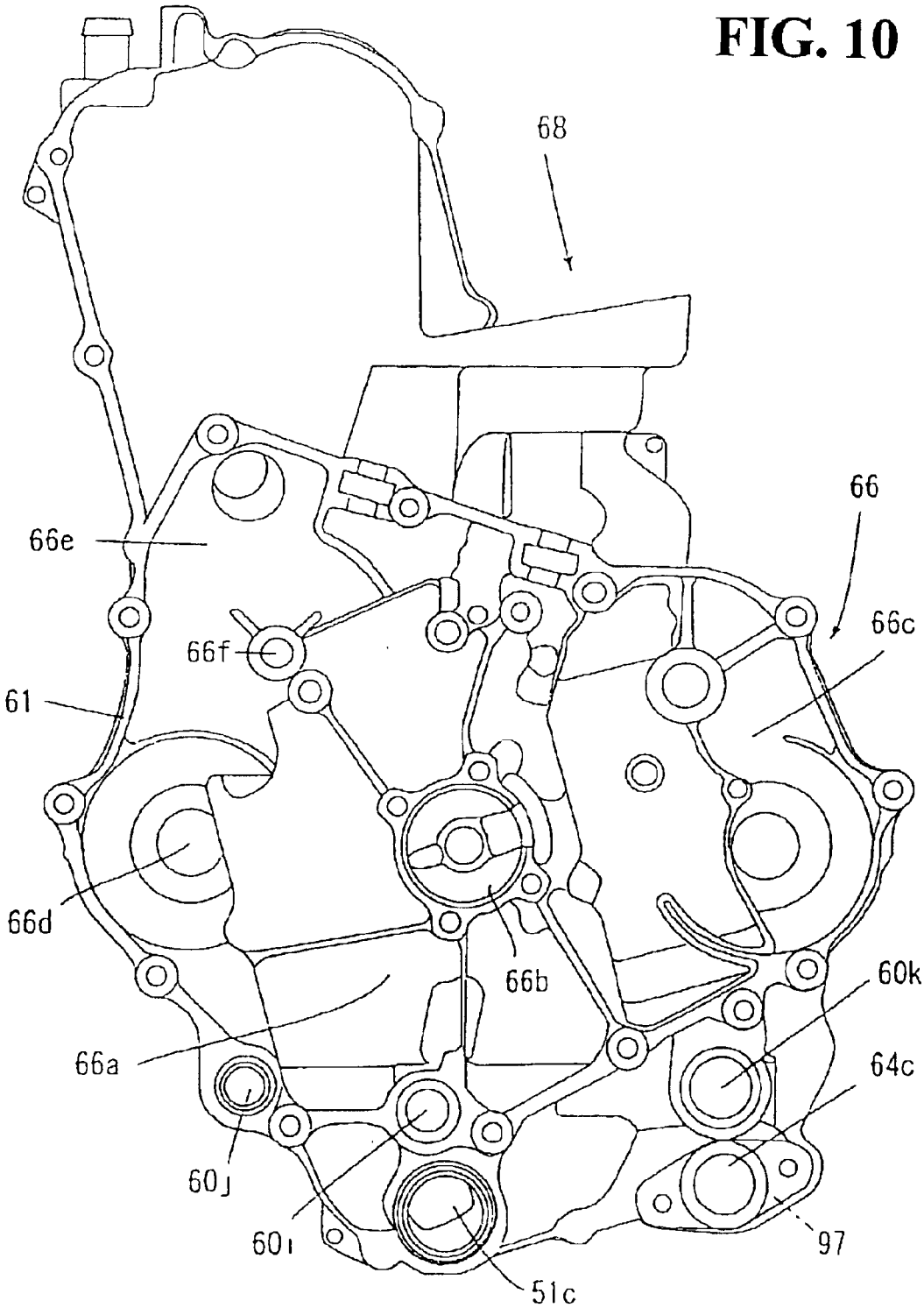
FIG. 10 is a rear view of the tank body 60.
Figure 11A:
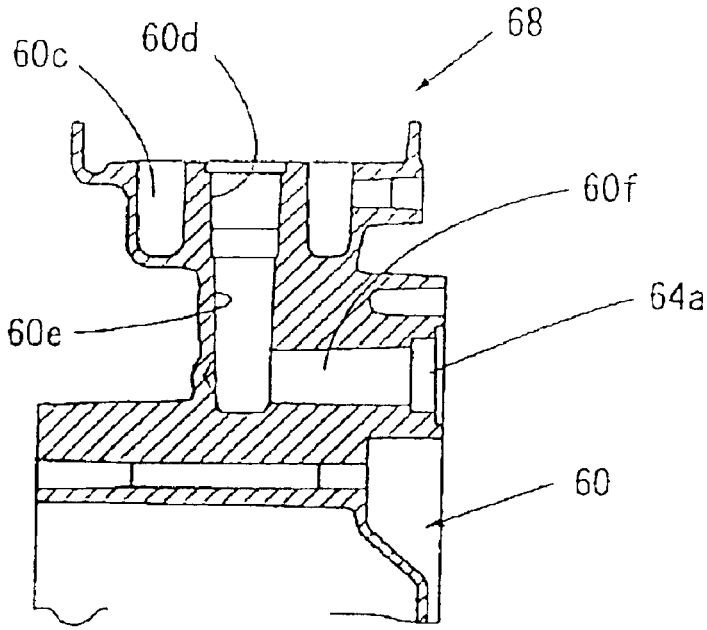
FIG. 11(*a*) is a cross sectional view taken along the line e—e in FIG. 9(*b*)
Figure 11B:
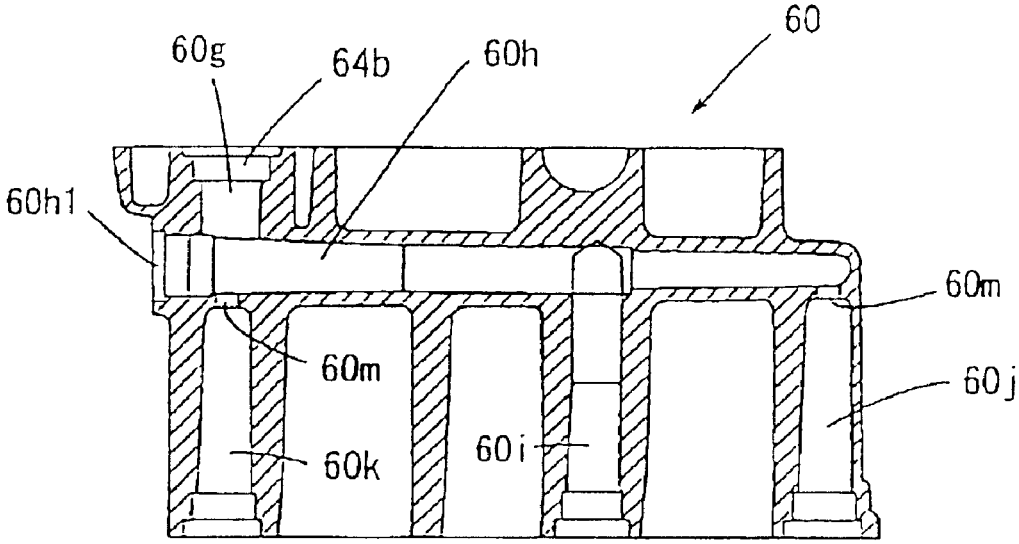
Figure 12B:
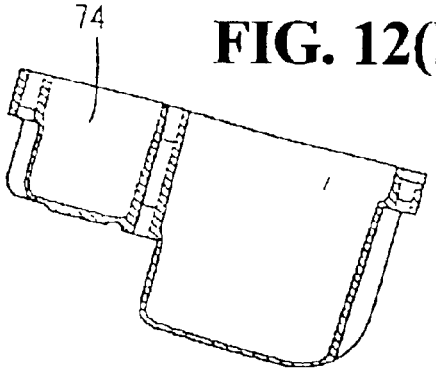
FIG. 12(*a*) is a plan view of a cover according to an embodiment of the present invention.
Figure 12D:
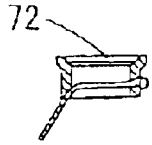
Figure 12A:
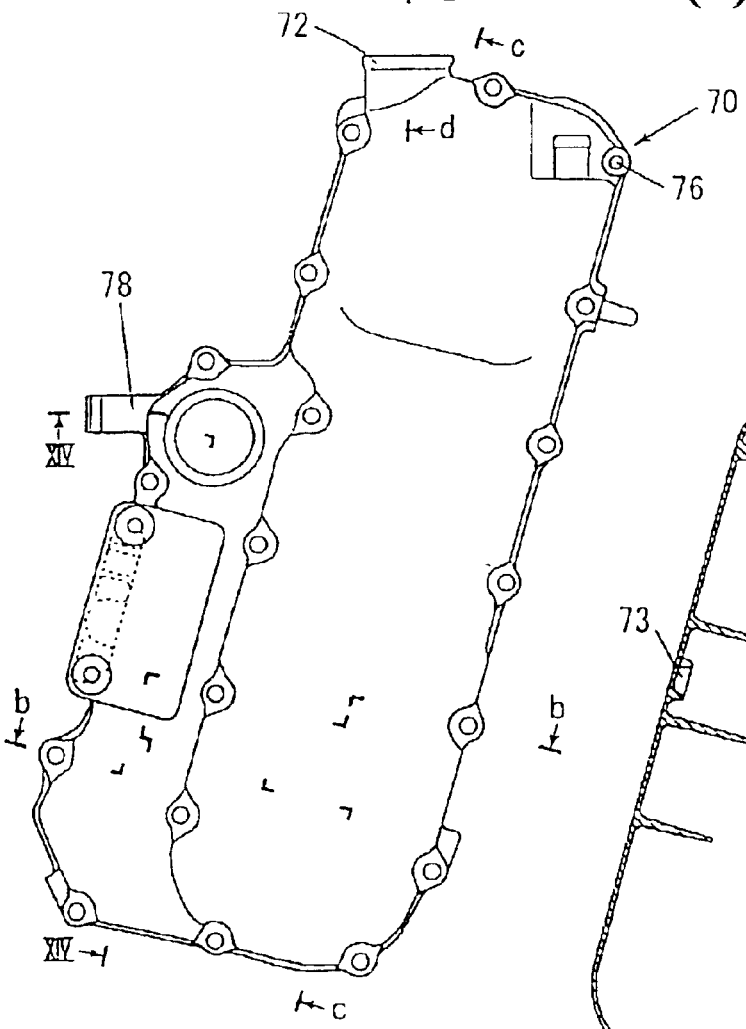
Figure 12C:
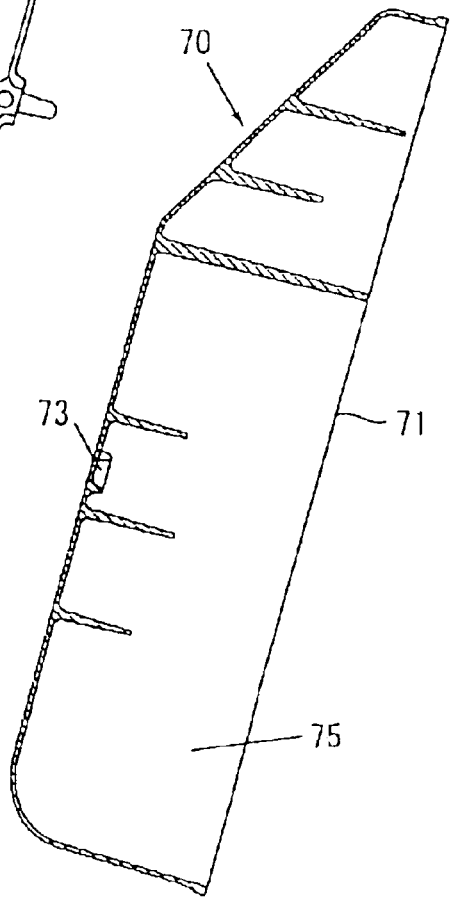
Figure 13B:
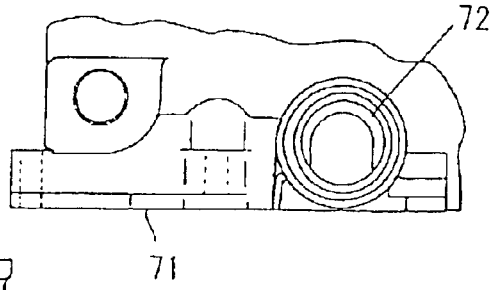
FIG. 13(*a*) is a rear view of the cover according to an embodiment of the present invention.
Figure 13A:
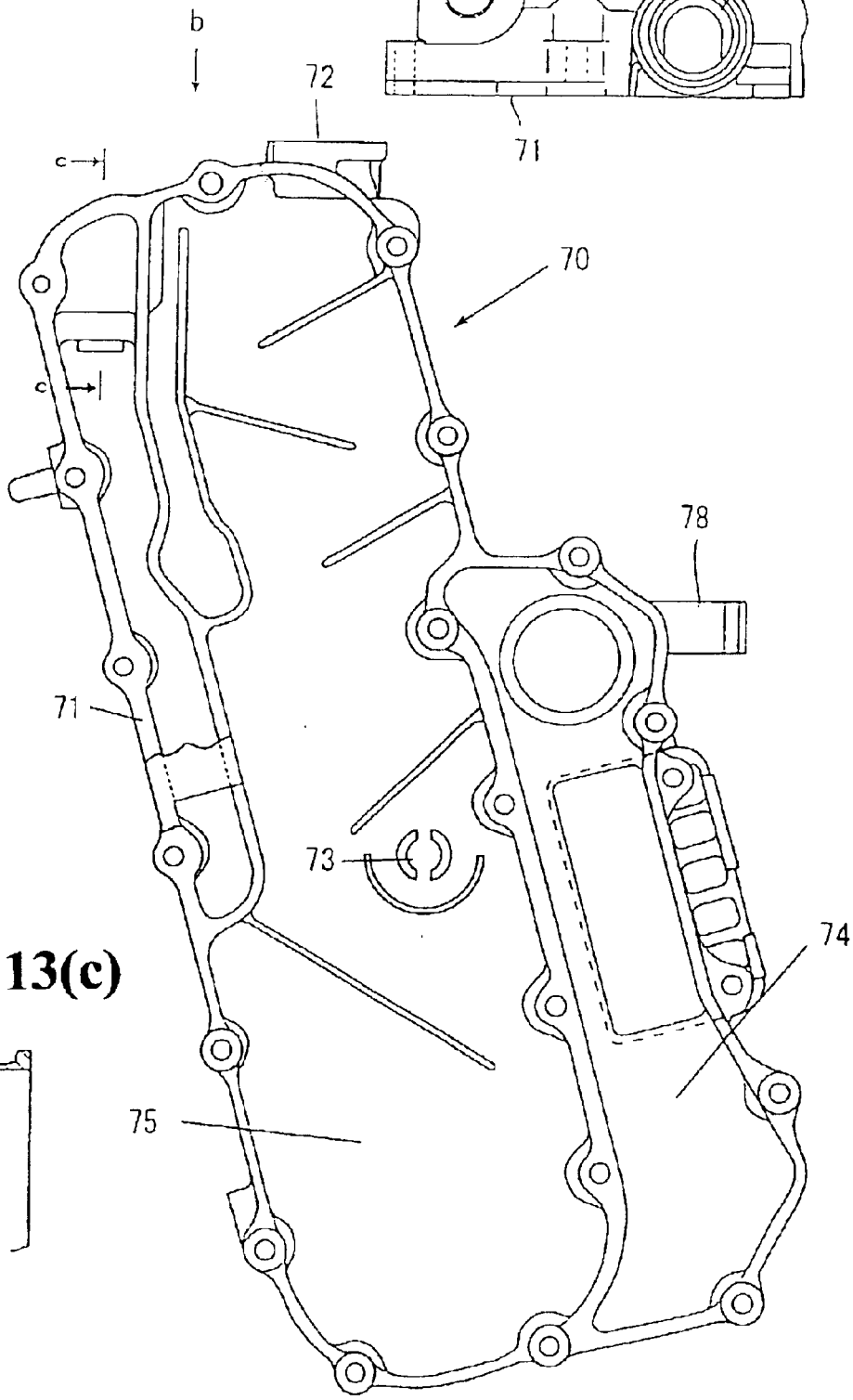
Figure 13C:
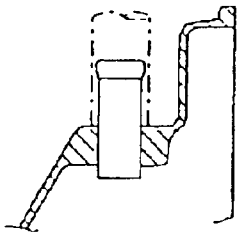
Figure 14:
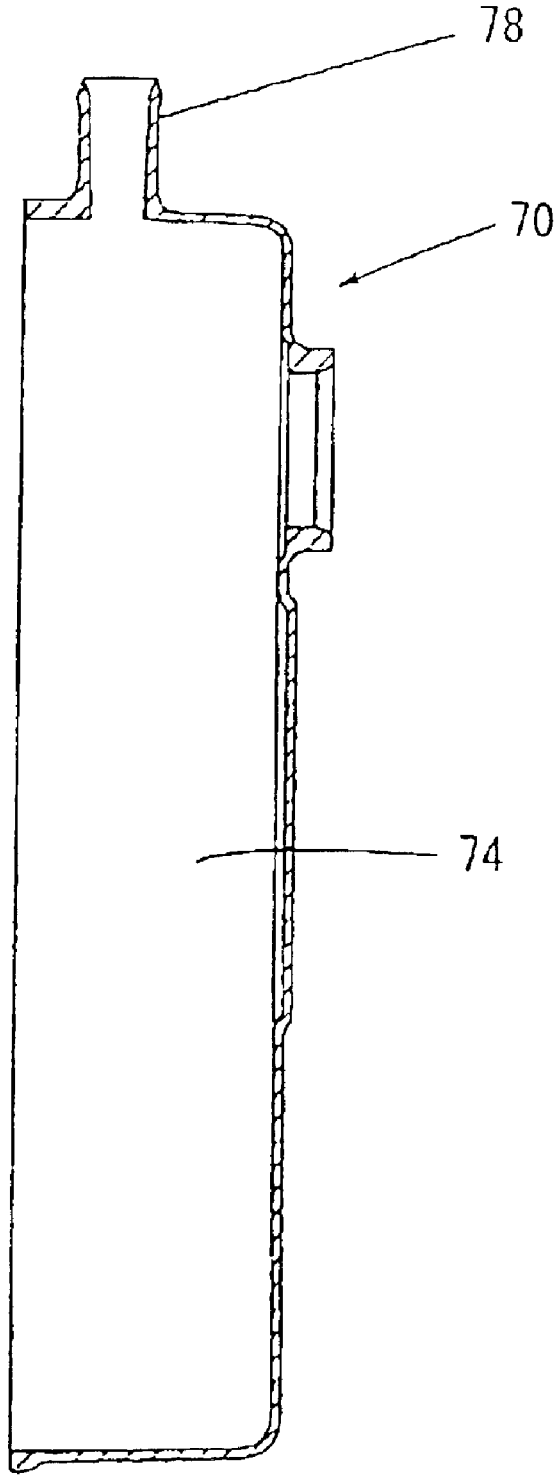
FIG. 14 is a cross sectional view taken along the line XIV—XIV in FIG. 12(*a*)
Figure 15:
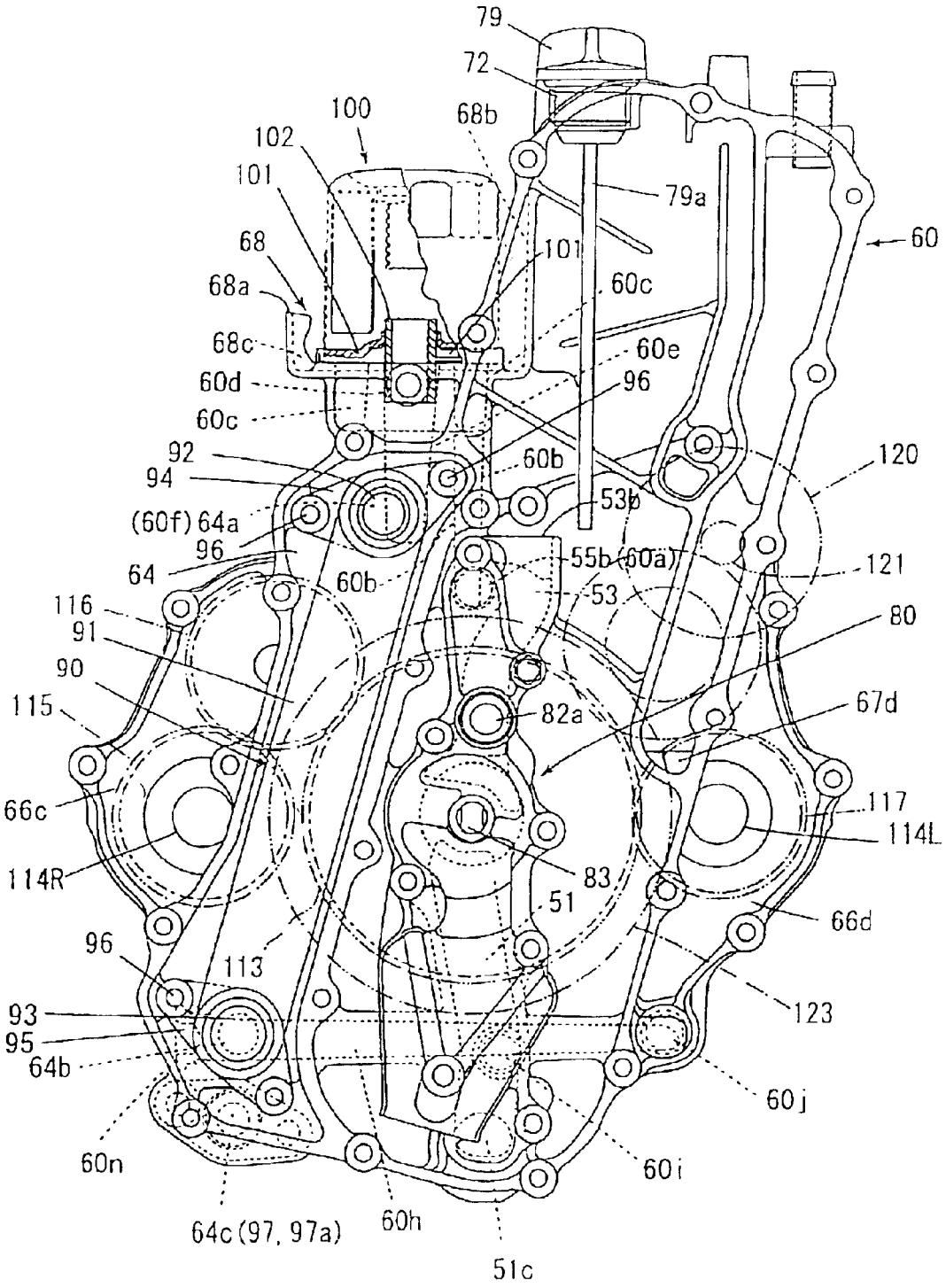
FIG. 15 is a partially enlarged view showing a state in which the cover is removed from the structure shown in FIG. 4.
Figure 16:
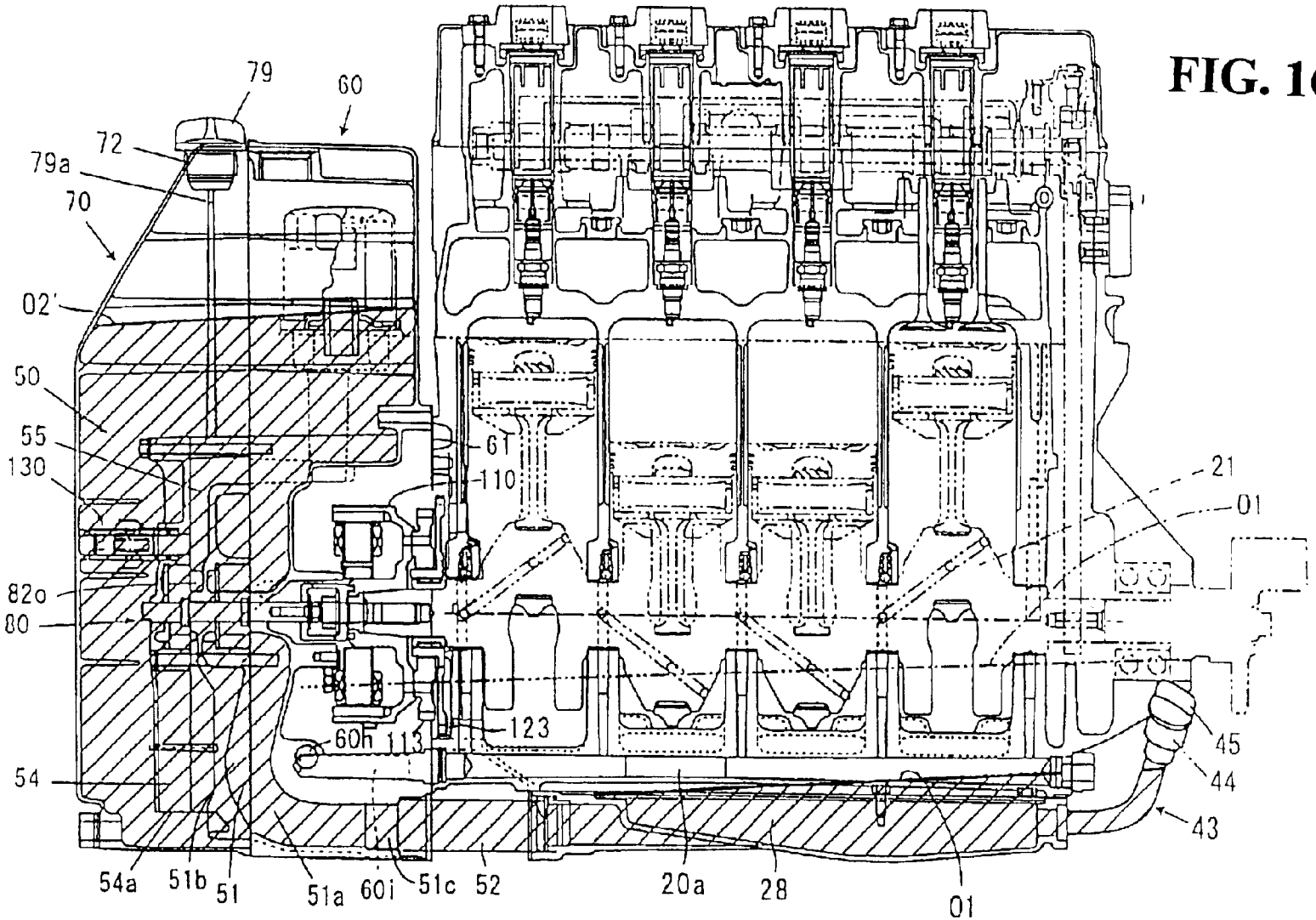
FIG. 16 is a right side view of a comparative example of an engine.
Figure 17:
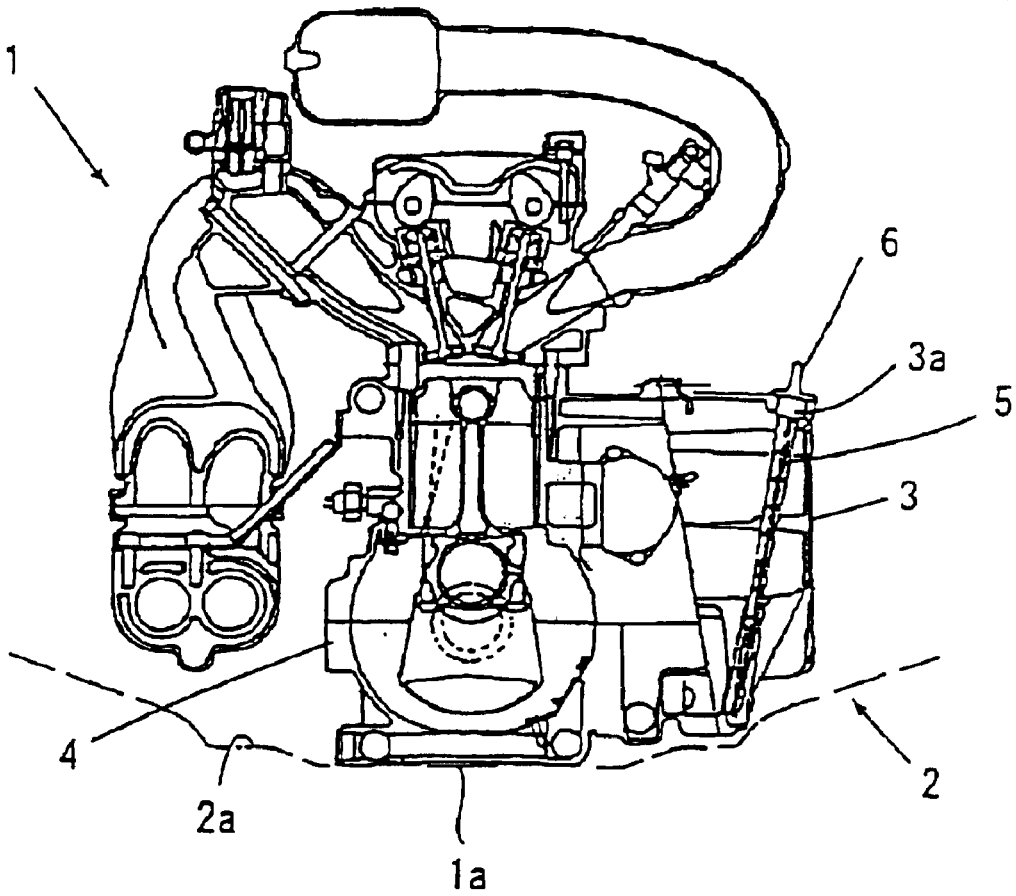
FIG. 17 BACKGROUND ART
FIG. 17 is an explanatory drawing of the related art.

The present invention will hereinafter be described with reference to the accompanying drawings. FIG. 1 is a side view of an exemplary small, planing boat having a lubrication unit for an engine according to an embodiment of the present invention. FIG. 2 is a plan view of the boat as seen in FIG. 1. FIG. 3 is a partially enlarged, cross sectional view taken along the line III—III in FIG. 1. FIG. 4 is a partially enlarged, cross sectional view of the engine taken along the line IV—IV in FIG. 1. FIG. 5 is a right side view of the engine according to the present invention. FIG. 6 is a left side view of the engine according to the present invention. FIG. 7 is a rear perspective view of the engine as viewed obliquely from a rear position. FIG. 8 is a partially enlarged view of FIG. 5. FIG. 9(*a*) is a plan view of a tank body according to an embodiment of the present invention. FIG. 9(*b*) is a front view of the tank body of the present invention. FIG. 9(*c*) is a cross sectional view taken along the line c—c in the FIG. 9(*b*). FIG. 9(*d*) is a cross sectional view taken along the line d—d in the FIG. 9(*a*). FIG. 10 is a rear view of the tank body 60. FIG. 11(*a*) is a cross sectional view taken along the line e—e in FIG. 9(*b*). FIG. 11(*b*) is a cross sectional view taken along the line f—f in FIG. 9(*b*). FIG. 12(*a*) is a plan view of a cover according to an embodiment of the present invention. FIG. 12(*b*) is a cross sectional view taken along the line b—b in FIG. 12(*a*). FIG. 12(*c*) is a cross sectional view taken along the line c—c in FIG. 12(*a*); and FIG. 12(*d*) is a cross sectional view taken along the line d—d in FIG. 12(*a*). FIG. 13(*a*) is a rear view of the cover according to an embodiment of the present invention. FIG. 13(*b*) is a view seen in the direction indicated by the arrow b in FIG. 13(*a*); FIG. 13(*c*) is a cross sectional view taken along the line c—c in FIG. 13(*a*). FIG. 14 is a cross sectional view taken along the line XIV—XIV in FIG. 12(*a*). FIG. 15 is a partially enlarged view showing a state in which the cover is removed from the structure shown in FIG. 4. FIG. 16 is a right side view of a comparative example of an engine.

As seen in FIGS. 1 through 3, an exemplary, small, planing boat 10 is a saddle riding type small watercraft in which an occupant sits on a seat 12 on a vessel body 11 and operates the boat 10 by gripping a steering handle 13 with a throttle lever. The vessel body 11 has a floating structure formed with a space 16 inside by joining a hull 14 and a deck 15. In the space 16 at the substantially center of the vessel body 11 (substantially centered with respect to the front, rear, left and right of the vessel body 11), an engine 20 is mounted on the hull 14, and a jet pump (jet propulsion pump) 30 driven by the engine 20 for propulsion is provided on the rear portion of the hull 14.

The jet pump 30 includes a flow path 33 extending from a water intake 17 opening on the boat bottom to the jet port 31 opening at the rear end of the vessel body and a deflector 32. The jet pump 30 also includes an impeller 34 disposed in the flow path 33, wherein a drive shaft 35 of the impeller 34 is connected to an output shaft 21 of the engine 20. When the impeller 34 is rotated by the engine 20, water drawn through the water intake 17 is emitted from the jet port 31 through the deflector 32, thereby propelling the vessel body 11. The revolutions of the engine 20 and a resulting a propulsion force generated by the jet pump 30 are controlled by rotating a throttle lever 13*a* (See FIG. 2) of the aforementioned steering handle 13. The deflector 32 is linked with the steering handle 13 with an operating wire (not shown) and is rotated by the operation of the handle 13, thereby being able to change the course. A fuel tank 40, and a storing chamber 41 are also provided in the vessel body.

FIG. 4 is a partially enlarged, cross sectional view of the engine taken along the line IV—IV in FIG. 1. FIG. 5 is a right side view of the engine according to the present invention. FIG. 6 is a left side view of the engine according to the present invention.

FIG. 7 is a rear perspective view of the engine as viewed obliquely from a rear position. FIG. 8 is a partially enlarged view of FIG. 5.

In the preferred embodiment, the engine 20 is a DOHC type, water-cooled, in-line, four-cylinder, dry sump, four-cycle engine. As shown in FIG. 1 and in FIG. 5, a crankshaft 21 is disposed so as to extend along the length of the vessel body 11. As shown in FIG. 4 and FIG. 7, a surge tank (intake chamber) 22 in communication with an intake port and an intercooler 23 are connected on the left side of the engine 20 when viewed with respect to the traveling direction of the vessel body 11. An exhaust manifold 24 (See FIG. 6) in communication with an exhaust port 20*o* is connected on the right side of the engine 20.

As shown in FIG. 6 and FIG. 7, a turbocharger 25 is disposed rearward of the engine 20, and an exhaust exit 24*o* of the exhaust manifold 24 is connected to a turbine unit 25T of the turbocharger 25. The aforementioned intercooler 23 is connected to a compressor unit 25C with a piping 26 (See FIG. 7). In FIG. 7, cooling water hoses 23*a*, 23*b* are connected to the intercooler 23.

As seen in FIGS. 1–2, exhaust gas that was used for rotating the turbine at the turbine unit 25T of the turbocharger 25 flows through an exhaust pipe 27*a*, a reverse flow prevention chamber 27*b* for preventing reverse flow of water, e.g., entrance of water into the turbocharger 25 or the like in case of vessel overturning, a water muffler 27*c*, and an exhaust and drain pipe 27*d*. The exhaust gas is then discharged into the pump chamber in which the jet pump 30 is stored.

As shown in FIG. 4 through FIG. 8, an oil tank 50 elongated along an extension of the crankshaft 21 and an oil pump 80 are integrally formed at the front portion of the engine 20, e.g., with respect to the traveling direction of the vessel body 11 which is the left portion in FIG. 1 and in FIG. 5. The oil pump 80 is provided in the oil tank 50. The oil tank 50 is constructed of a tank body 60 joined on the front surface of the engine 20 and a cover 70 joined on the front surface of the tank body 60.

FIG. 9(*a*) is a plan view of a tank body according to an embodiment of the present invention. FIG. 9(*b*) is a front view of the tank body of the present invention. FIG. 9(*c*) is a cross sectional view taken along the line c—c in the FIG. 9(*b*). FIG. 9(*d*) is a cross sectional view taken along the line d—d in the FIG. 9(*a*). FIG. 10 is a rear view of the tank body 60. FIG. 11(*a*) is a cross sectional view taken along the line e—e in FIG. 9(*b*). FIG. 11(*b*) is a cross sectional view taken along the line f—f in FIG. 9(*b*). FIG. 12(*a*) is a plan view of a cover according to an embodiment of the present invention. FIG. 12(*b*) is a cross sectional view taken along the line b—b in FIG. 12(*a*). FIG. 12(*c*) is a cross sectional view taken along the line c—c in FIG. 12(*a*). FIG. 12(*d*) is a cross sectional view taken along the line d—d in FIG. 12(*a*). FIG. 13(*a*) is a rear view of the cover according to an embodiment of the present invention. FIG. 13(*b*) is a view seen in the direction indicated by the arrow b in FIG. 13(*a*). FIG. 13(*c*) is a cross sectional view taken along the line c—c in FIG. 13(*a*). FIG. 14 is a cross sectional view taken along the line XIV—XIV in FIG. 12(*a*). FIG. 15 is a partially enlarged view showing a state in which the cover is removed from the structure shown in FIG. 4.

As shown in FIG. 9, FIG. 10, and FIG. 15, the tank body 60 includes a joint surface 61 to be joined to the front surface of the engine 20, a joint surface 62 to be joined to the cover 70, a mounting surface 63 for the oil pump 80, a mounting section 64 for the water-cooled oil cooler 90 that will be described later, and a generally elongated oil storage portion 65 defined by partition walls and outer walls constituting these mounting surfaces. A rotor 110*a* for an ACG (electric generator) 110, balancer shafts 114L, 114R, and a cover section 66 of the drive chamber for a starter motor 120 are also provided. A mounting section 68 for an oil filter 100 is also provided in the tank body 60.

As shown in FIG. 8, FIG. 9, FIG. 10 and FIG. 15, the cover section 66 of the tank body 60 includes an ACG cover section 66*a* for covering the ACG rotor 110*a*, a gear 113 for driving the balancer, and a gear 123 for the starter, a coupling cover, section 66*b* for covering a coupling 111 portion thereof, a right balancer drive system cover section 66*c* for covering a balancer gear 115 and an idle gear 116, a left balancer drive system cover section 66*d* for covering the balancer gear 117, and a starter drive system cover section 66*e* for covering a pinion gear 121 and a reduction gear 122 of the aforementioned starter motor 120. A hole 66*f* for supporting the shaft of the reduction gear 122 is also shown.

The tank body 60 described above is joined to the front surface of the engine 20 on the joint surface 61 so as to cover the aforementioned respective portions with the cover section 66, and integrally secured on the front surface of the engine 20 with bolts (not shown). The tank body 60 is mounted on the front surface of the engine 20 after an oil pump 80 and an oil cooler 90 that will be described later are mounted thereon.

As shown in FIG. 8 and FIG. 15, the oil pump 80 includes a first case 81 to be joined to the aforementioned tank body 60, a second case 82 to be joined to the first case 81, a pump shaft 83 to be provided so as to pass through the first and second cases, an oil-recovering rotor 84 connected to the pump shaft 83 in the aforementioned first case 81, and an oil-feeding rotor 85 connected to the pump shaft 83 in the aforementioned second case 82. The oil-recovering rotor 84 forms an oil-recovering pump with the first case 81, and the oil-feeding rotor 85 forms an oil-feeding pump with the first and the second cases 81, 82.

The oil pump 80 is mounted on the front surface of the tank body 60 by joining a joint surface 81*a* for the tank body 60 on the first case 81 to a joint surface 69 on the front surface (See FIGS. 9(*b*) (*c*)) of the oil tank body 60 formed in identical shape thereto. A bolt 88 is then inserted (See FIG. 8) through a through port 80*a* of the first and the second cases 81, 82 and the bolt 88 is fastened. After the oil pump 80 is mounted on the tank body 60 in this manner, a coupling 89 is fixed to the rear end of the pump shaft 83 from the rear of the tank body 60.

As shown in FIG. 6, FIG. 9(*b*) and FIG. 15, the water-cooled oil cooler 90 is mounted on the tank body 60 on the front surface side of the mounting section 64 for the oil cooler 90. The mounting section 64 on the tank body 60 is formed with an upper hole 64*a* and a lower hole 64*b* in communication with an oil passage described hereinafter. As shown in FIG. 6, the oil cooler 90 includes a plurality of heat exchange plates 91 in which oil passes, an oil inlet pipe 92 in communication with the interior of the plate 91 at the upper portion thereof, an oil exit pipe 93 in communication therewith at the lower portion thereof, and flange sections 94, 95 for mounting on the tank body 60 as shown in FIG. 15.

The oil cooler 90 is mounted on the mounting section 64 on the tank body 60 by connecting the inlet pipe 92 to the upper hole 64*a* of the tank body 60 and the exit pipe 93 to the lower hole 64*b* of the tank body 60, and fastening the aforementioned flange sections 94, 95 with bolts (not shown). In FIG. 15, a hole 96 for inserting bolts is formed on the flange sections 94, 95.

A cooling water introducing pipe 97 in communication with a hole 64*c* (See FIG. 9 and FIG. 15) opening to the aforementioned mounting section 64 for introducing cooling water into the mounting section 64 and a storage section 74 for the oil cooler 90 of the cover 70 is provided on the tank body 60. The cover 70 is provided with a water drain pipe 78 as shown in FIGS. 12 to 14. A cooling water hose 38*a* extending from a cooling water dispensing section 30*a* (see FIG. 7) in the jet pump 30 is directly connected to the introducing pipe 97 without interposing any other object to be cooled in between. A drain pipe 23*c* is connected to the exhaust pipe 78 as shown in FIG. 6. Water from the drain pipe 78 is fed to the water jacket of the engine 20 via the drain pipe 23*c*.

As shown in FIG. 12 to FIG. 14, the cover 70 includes a joint surface 71 to be joined to the tank body 60, an oil filling port 72, a holding section 73 for an oil relief valve 130, the aforementioned storage section 74 for the oil cooler 90, and an oil storage section 75 defined by the outer walls and the partition walls. After the tank body 60, the oil pump 80, and the oil cooler 90 are mounted on the front surface of the engine 20, a rear end 131 of the relief valve 130 is fitted into a hole 82*a* formed on the front surface of the second case 82 of the oil pump 80 as shown in FIG. 8. The cover 70 is joined and secured to the front surface of the tank body 60 while holding the distal end 132 of the relief valve 130 by the aforementioned holding section 73 with a bolt (not shown). In FIG. 12(*a*), the insertion holes 76 for the bolt are shown.

When the tank body 60 and the cover 70 are joined, the oil storage sections 65, 75 of each of the tank body 60 and the cover 70 define a single, vertically elongated oil storage section. An oil filter 100 is mounted on a mounting section 68 for the oil filter 100 on the tank body 60. As described above, the oil tank 50 or tank body 60 and the cover 70 including the oil pump 80, the oil cooler 90, and the relief valve 130 built therein are mounted on the front surface of the engine 20. The oil filter 100 is mounted and an oil passage as described below is formed.

As shown in FIG. 5 and FIG. 8, an oil recovery path 51 is defined by the front surface of the tank body 60 and the rear surface of the first case 81 of the oil pump 80. The oil recovery path 51 is defined by an oil passage 51*a* (See FIG. 9(*b*)) formed on the side of the tank body 60 and an oil passage 51*b* formed on the side of the first case 81 of the oil pump 80 so as to face toward the oil passage 51*b*. The lower end 51*c* of the oil recovery path 51 is in communication with the crankcase 28 (more specifically with an small oil pan provided at the lower portion of the crankcase) in the engine 20 via a pipe 52, and an upper end 51*d* thereof is in communication with a recovered oil inlet port 81*i* formed on the first case 81 of the oil pump 80.

Likewise, a recovered oil discharge path 53 is defined by the front surface of the tank body 60 and the back surface of the first case 81 of the oil pump 80. The recovered oil discharge path 53 is defined by an oil passage 53*a* (See FIG. 9(*b*)) formed on the side of the tank body 60 and a recovered oil discharge port 810 formed on the side of the first case 81 on the oil pump 80 so as to face toward the oil passage 53*a*.

The upper end 53*b* of the recovered oil discharge port 53 opens into the oil tank 50, e.g., into the oil storage section (See FIG. 9(*b*), FIG. 15). As shown in FIG. 8, an intake path 54 of feed oil and a discharge path 55 are defined by the front surface of the first case 81 and the rear side of the second case 82 of the oil pump 80. The lower end 54*a* of the intake path 54 opens into the oil tank 50 (that is, oil storage section), and the upper end 54*b* is in communication with a feed oil inlet port 82*i* of the oil feed pump. The intake path 54 is provided with a screen oil filter 54*c*.

The lower end 55*a* of the discharge path 55 is in communication with a feed oil discharge port 82*o* of the oil feed pump, and the upper end 55*b* laterally passes through the upper portion of the first case 81 and then in communication with a lateral hole 60*a* formed on the tank body 60 (See FIG. 9(*b*), FIG. 15). The lateral hole 60*a* is in communication with the vertical hole 60*b* formed also on the tank body 60 as shown in FIG. 8, FIG. 9(*b*) and FIG. 15. The upper end 60*c* of the vertical hole 60*b* opens into the mounting section 68 for the oil filter 100 in a ring-shape in plan view (See FIG. 9(*a*)), and an oil inflow path 101 of the oil filter 100 (See FIG. 15) is brought into communication with the opening 60*c*.

A mounting hole 82*a* for the aforementioned relief valve 130 opens into the aforementioned discharge path 55, and the relief valve 130 is mounted into the mounting hole 82*a* in a manner described above. As shown in FIG. 15, an oil exit pipe 102 of the oil filter 100 is formed with a male thread, and the oil filter 100 is mounted on the mounting section 68 of the tank body 60 by screwing the oil exit pipe 102 into a female screw hole 60*d* formed at the mounting section 68 of the tank body 60.

The mounting section 68 is integrally formed with a peripheral wall 68*a*, and an oil receiving section 68*c* is defined by the peripheral wall 68*a* and a side wall surface 68*b* of the tank body 60 continuing therefrom. Therefore, oil that may drop when the oil filter 100 is attached to or detached from the mounting section 68 is received by the oil receiving section 68*c*, and is returned into the oil tank though the aforementioned female screw hole 60*d* or through the opening 60*c*, and thus the inside of the vessel body is protected from the contamination by oil.

As shown in FIGS. 9(*a*), (*b*), and FIG. 15, the female screw hole 60*d* is formed with a vertical hole 60*e* at the lower portion and a lateral hole 60*f* in communication with the lower end of the vertical hole 60*e*. The lateral hole 60*f* is in communication with the inlet pipe 92 of the oil cooler 90 via an upper hole 64*a* at the aforementioned mounting section 64 of the oil cooler 90 (See FIG. 6). A lower hole 64*b* of the aforementioned tank body 60 to which the exit pipe 93 of the oil cooler 90 is connected is formed with an oil passage 60*g* in communication with the lower hole 64*b* and a oil distribution path 60*h* in communication with the passage 60*g* as shown in FIG. 11(*b*). Further, the oil distribution path 60*h* is in communication with a main gallery feed path 60*i* for feeding oil to a main gallery 20*a* (See FIG. 5) of the engine 20, a left balancer feed path 60*j* for feeding oil to the bearing section of the aforementioned left balancer 114L, and a right balancer feed path 60*k* for feeding oil to the bearing section of the right balancer 114R.

The feed paths 60*j,k* for the balancers 114 (L,R) are in communication with the oil distribution path 60*h* via a narrow path 60*m* respectively. One end 60*h*1 of the oil distribution path 60*h* is closed by a plug 60*n* (See FIG. 6). The oil fed from the oil cooler 90 to the main gallery 20*a* of the engine 20 returns to a crankcase 28 after being fed to the each part of the engine, and the oil returned into the crankcase 28 is recovered through the pipe 52, the recovery path 51, the oil pump 80 (recovery pump), the recovered oil discharge path 53 into the oil tank 50, and is circulated from the aforementioned intake path 54 along the path described above.

The aforementioned oil filling port 72 (See FIG. 12, FIG. 13) constitutes an opening provided on top of the oil tank 50. As shown in FIG. 5 and FIG. 7, the oil filing port (opening) 72 is provided with a cap 79 for closing the same so as to be detachable, and the cap 79 is provided with a dip stick (oil level gauge) 79*a*, which is free to be inserted into and pulled out from the opening 72.

As shown in FIG. 5 and FIG. 7, an oil drain pipe 43 is connected to the rear of the lower portion of the crankcase 28. The oil drain pipe 43 extends upward from the lower portion of the crankcase 28, and an opening 44 at the upper end is provided with a cap 45 for closing the opening 44 so as to be detachable. As shown in FIG. 5, the opening 44 opens at the position upwardly of the oil surface 01 in the crankcase 28 in the case where the engine 20 has been left to stand for a long time, e.g., has not been operated for a long period of time and the oil O (the shadowed portion in FIG. 5) in the oil tank 50 is returned into the crankcase 28. The oil surface $O_2$ is also shown in the oil tank 50.

In FIG. 5, a supporting member 47 supporting the mid-section of the oil drain pipe 43 on the engine 20 is shown. According to the lubrication unit for engines as described thus far, the following effects are achieved. The engine 20 includes an oil feed pump for feeding oil in the oil tank 50 to the engine 20, the crankcase 28 in which oil used for lubricating each part of the engine 20 is collected, and the oil recovery pump for feeding oil in the crankcase 28 to the oil tank 50. Since the lubrication unit for engines includes an oil drain pipe 43 connected to the lower portion of the crankcase 28 and extending upward, and an opening 72 provided on top of the oil tank 50, the oil in the oil tank 50 can be drained by inserting a tube (not shown) for drawing oil from the opening 72 on top of the oil tank when changing oil. The oil in the crankcase 28 can be drained by inserting a tube for drawing oil from the opening 44 of the oil drain pipe 43.

Therefore, according to this lubrication oil for engines, oil changing can be performed easily and satisfactorily. When the engine 20 is mounted on the small planing boat 10 and there is no working space between the engine bottom and the ship bottom 14*a* (See FIG. 4), oil changing can be performed easily and satisfactorily by the operation from above the engine 20. Since the opening 44 of the oil drain pipe 43 is opening at the position upwardly of the oil level O1 in the crankcase 28 at the moment when the oil in the oil tank 50 is returned into the crankcase 28 as is described in conjunction with FIG. 5, the following effects are additionally achieved.

When the engine 20 is left standing for a long period of time, the oil in the oil tank 50 may gradually be returned into the crankcase 28 through the oil pump, e.g., oil recovery pump or oil feed pump. In such a case, assuming that the opening 44 of the oil drain pipe 43 is opened below the oil level O1 (see phantom line O1 in the same figure) in the crankcase 28 after the engine 20 was left standing for a long period of time as shown in FIG. 16, when the cap 45 clogging the opening 44 is removed, the oil leaks.

In the lubrication unit for engines in this embodiment, as shown in FIG. 5, since the opening 44 of the oil drain pipe 43 opens upwardly of the oil level O1 in the crankcase 28 at the moment when the oil in the oil tank 50 is returned into the crankcase 28, leakage of oil when the cap 45 clogging the opening 44 is removed after the engine 20 is left stand for long time may be avoided.

In FIG. 16, O1' designates an oil level in the crankcase 28 after the engine 20 has been operated for a prescribed period of time, and O2' also designates an oil level in the oil tank 50. Since the opening 72 on top of the oil tank 50 is free to insert and pull out the dip stick 79*a*, and the opening 44 of the oil drain pipe 43 is free to insert and pull out the dip stick 79*a* as well, the following additional effects may be achieved.

As shown in FIG. 5, when the engine 20 is left stand for a long time, the oil in the oil tank 50 may gradually be returned into the crankcase 28 through the oil pump. In such a case, the normal method of measurement, e.g., a method of measurement by the use of the dip stick 79*a* provided on the cap 79 through the aforementioned opening 72 of the oil tank, presents a problem that not only the oil quantity, but also the presence or absence of oil cannot be checked (as seen from FIG. 5).

With the lubrication unit of this embodiment, the oil quantity can be checked by inserting the dip stick 79*a* through the opening 44 of the oil drain pipe 43, e.g., the presence or absence of oil can also be checked. Even when the engine 20 is left standing for a long period of time, the presence or absence of oil and the approximate oil quantity can be checked before starting the engine.

In order to measure the oil quantity relatively accurately, the oil quantity (see oil level O2') can be checked relatively accurately by inserting the dip stick 79*a* through the opening 72 on top of the oil tank after operation of the engine for a prescribed period of time. Since the engine 20 is an engine to be mounted on the small planing boat 10 with the crankshaft 21 thereof oriented in the fore-and-aft direction, and the oil tank 50 is integrally formed with the front portion of the engine 20 so as to be elongated in the vertical direction and is formed with the aforementioned opening 72 on top thereof, as shown in FIG. 4, oil can be drained further easily by inserting the tube for sucking oil through the opening 72 on top of the vertically elongated Oil tank 50 though the engine 20 is mounted on the small planing boat 10.

In FIG. 4, an opening 15*a* formed on the upper portion of the vessel body by removing the seat 12, and the opening 72 on top of the aforementioned oil tank 50 faces toward the opening 15*a*. Therefore, oil changing may be performed through the opening 15*a* provided on the upper portion of the vessel body. Oil changes can be performed easily and satisfactorily from a position above the vessel body.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An engine comprising:

a crankcase;

an oil tank being provided independently of an interior of the crankcase and having oil therein;

an oil feed pump for feeding oil in the oil tank to the engine, wherein oil used for lubricating parts of the engine is collected within said crankcase;

an oil recovery pump for feeding oil in the crankcase to said oil tank;

an oil drain pipe connected to a lower portion of said crankcase and extending upwardly therefrom and having an opening at an upper portion thereof;

a cap, wherein said cap is operatively connected to the opening at the upper portion of said drain pipe; and an oil tank opening provided on an upper portion of said oil tank.

2. The engine according to claim 1, wherein the opening of said oil drain pipe opens at a position upward of an oil level in the crankcase at a point where the oil in said oil tank is capable of being returned into said crankcase.

3. The engine according to claim 2, further comprising a dip stick, wherein said dip stick is capable of being inserted and removed from the opening on the upper portion of said oil tank and the opening of said oil drain pipe.

4. The engine according to claim 1, further comprising a dip stick, wherein said dip stick is capable of being inserted and removed from the opening on the upper portion of said oil tank and the opening of said oil drain pipe.

5. A small planning boat, said small planning boat comprising:

an engine mounted on the small planing boat with a crankshaft thereof oriented in a fore-and-aft direction of the boat, wherein said engine further includes a crankcase;

an oil tank being provided independently of an interior of the crankcase and having oil therein;

an oil feed pump for feeding oil in the oil tank to the engine, wherein oil used for lubricating parts of the engine is collected within said crankcase;

an oil recovery pump for feeding oil in the crankcase to said oil tank;

an oil drain pipe connected to a lower portion of said crankcase and extending upwardly therefrom and having an opening at an upper portion thereof;

a cap, wherein said cap is operatively connected to the opening at the upper portion of said drain pipe; and an oil tank opening provided on an upper portion of said oil tank, wherein said oil tank is integrally formed with a front portion of the engine and elongated in a vertical direction.

6. The boat according to claim 5, wherein the opening of said oil drain pipe opens at a position upward of an oil level in the crankcase at a point where the oil in said oil tank is capable of being returned into said crankcase.

7. The boat according to claim 6, further comprising a dip stick, wherein said dip stick is capable of being inserted and removed from the opening on the upper portion of said oil tank and the opening of said oil drain pipe.

8. The boat according to claim 6, further comprising a dip stick, wherein said dip stick is capable of being inserted and removed from the opening on the upper portion of said oil tank and the opening of said oil drain pipe.

9. A lubrication system for an engine having a crankcase, said lubrication system comprising:

an oil tank being provided independently of an interior of the crankcase and having oil therein;

an oil feed pump for feeding oil in the oil tank to the engine, wherein oil used for lubricating parts of the engine is collected within said crankcase;

an oil recovery pump for feeding oil in the crankcase to said oil tank;

an oil drain pipe connected to a lower portion of said crankcase and extending upwardly therefrom and having an opening at an upper portion thereof;

a cap, wherein said cap is operatively connected to the opening at an upper portion of said drain pipe; and an oil tank opening provided on an upper portion of said oil tank.

10. The lubrication system according to claim 9, wherein the opening of said oil drain pipe opens at a position upward of an oil level in the crankcase at a point where the oil in said oil tank is capable of being returned into said crankcase.

11. The lubrication system according to claim 10, further comprising a dip stick, wherein said dip stick is capable of being inserted and removed from the opening on the upper portion of said oil tank and the opening of said oil drain pipe.

12. The lubrication system according to claim 9, further comprising a dip stick, wherein said dip stick is capable of being inserted and removed from the opening on the upper portion of said oil tank and the opening of said oil drain pipe.

* * * * *